US009649235B1

(12) United States Patent
McComb-Jones

(10) Patent No.: US 9,649,235 B1
(45) Date of Patent: May 16, 2017

(54) RETRACTABLE CANOPY FOR A WHEELCHAIR

(71) Applicant: Shelia McComb-Jones, Lithonia, GA (US)

(72) Inventor: Shelia McComb-Jones, Lithonia, GA (US)

( * ) Notice: Subject to any disclaimer, the term of this patent is extended or adjusted under 35 U.S.C. 154(b) by 0 days.

(21) Appl. No.: 15/006,650

(22) Filed: Jan. 26, 2016

(51) Int. Cl.
*A61G 5/10* (2006.01)
*A47C 7/66* (2006.01)

(52) U.S. Cl.
CPC . *A61G 5/10* (2013.01); *A47C 7/66* (2013.01)

(58) Field of Classification Search
CPC ..... A47C 7/66; A61G 5/10; E04H 15/06
See application file for complete search history.

(56) References Cited

U.S. PATENT DOCUMENTS 4,924,896 A * 5/1990 Carter ..... A47C 7/66 135/117
5,168,889 A 12/1992 Diestel
5,203,363 A * 4/1993 Kidwell ..... A47C 7/66 135/90
5,301,975 A 4/1994 Rivera
5,318,055 A * 6/1994 Olaniyan ..... A45B 11/02 135/16
5,921,258 A 7/1999 Francois
6,845,780 B2 * 1/2005 Bishirjian ..... E04H 15/02 135/96
D532,343 S 11/2006 Butler
7,140,678 B1 * 11/2006 Grant ..... A47C 7/66 135/143
7,316,450 B2 1/2008 Ayers
7,861,735 B2 1/2011 Stepaniuk
7,909,395 B2 * 3/2011 Reeb ..... A47C 7/66 135/95
8,215,421 B2 7/2012 Schneider
8,387,641 B1 * 3/2013 Ilan ..... A61G 5/10 135/34.2
8,997,770 B1 4/2015 Martin
2012/0192905 A1 8/2012 Boss
2015/0296990 A1 * 10/2015 Malik ..... A61G 5/10 280/47.38

FOREIGN PATENT DOCUMENTS

GB 2406311 A * 3/2005 ..... B62B 9/14
GB 2482695 A 8/2010
GB 2445010 A 4/2015

* cited by examiner

*Primary Examiner* — Noah Chandler Hawk

(57) ABSTRACT

The retractable canopy for wheelchair is a convertible top for a wheelchair. The retractable canopy for wheelchair is a convertible design that can be deployed or retracted as needed to protect the occupant of the wheelchair from weather. The retractable canopy for wheelchair is a collapsible canopy structure that provides overhead protection from weather and that can be stored in a boot when the retractable canopy for wheelchair is not in use. Optionally, the retractable canopy for wheelchair can have a motorized deployment and retraction system. The retractable canopy for wheelchair includes a boot, a canopy, a plurality of clips, and an extension structure.

3 Claims, 6 Drawing Sheets

RETRACTABLE CANOPY FOR A WHEELCHAIR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of domestic articles and chairs, more specifically, an accessory configured for use in protecting a wheelchair against weather.

SUMMARY OF INVENTION

The retractable canopy for wheelchair is a convertible top for a wheelchair. The retractable canopy for wheelchair is a convertible design that can be deployed or retracted as needed to protect the occupant of the wheelchair from weather. The retractable canopy for wheelchair is a collapsible canopy structure that provides overhead protection from weather and that can be stored in a boot when the retractable canopy for wheelchair is not in use. Optionally, the retractable canopy for wheelchair can have a motorized deployment and retraction system.

These together with additional objects, features and advantages of the retractable canopy for wheelchair will be readily apparent to those of ordinary skill in the art upon reading the following detailed description of the presently preferred, but nonetheless illustrative, embodiments when taken in conjunction with the accompanying drawings.

In this respect, before explaining the current embodiments of the retractable canopy for wheelchair in detail, it is to be understood that the retractable canopy for wheelchair is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the retractable canopy for wheelchair.

It is therefore important that the claims be regarded as including such equivalent construction insofar as they do not depart from the spirit and scope of the retractable canopy for wheelchair. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention.

They are meant to be exemplary illustrations provided to enable persons skilled in the art to practice the disclosure and are not intended to limit the scope of the appended claims.

DETAILED DESCRIPTION OF THE EMBODIMENT

Figure 1:
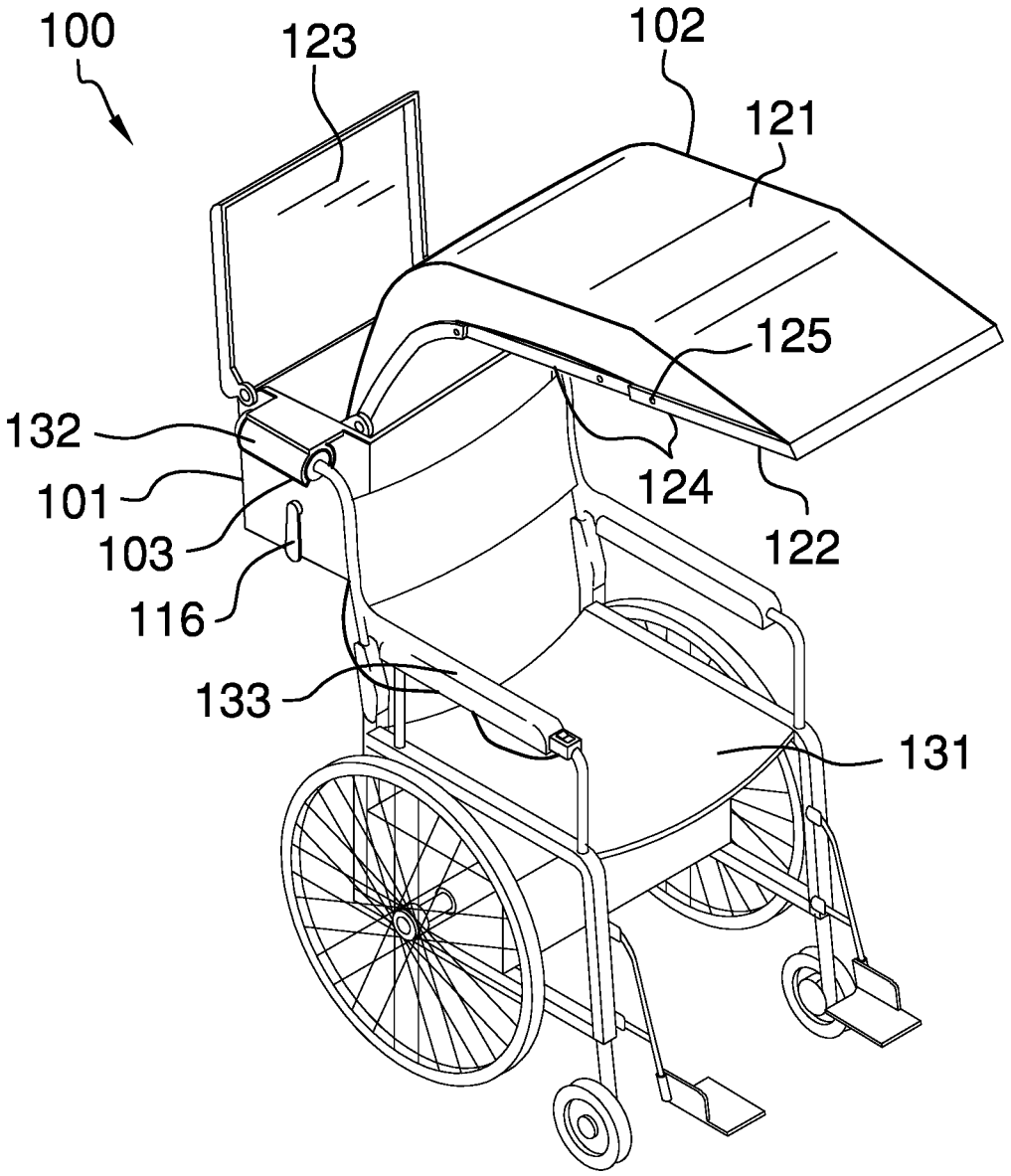
FIG. 1 is a perspective view of an embodiment of the disclosure.
Figure 2:
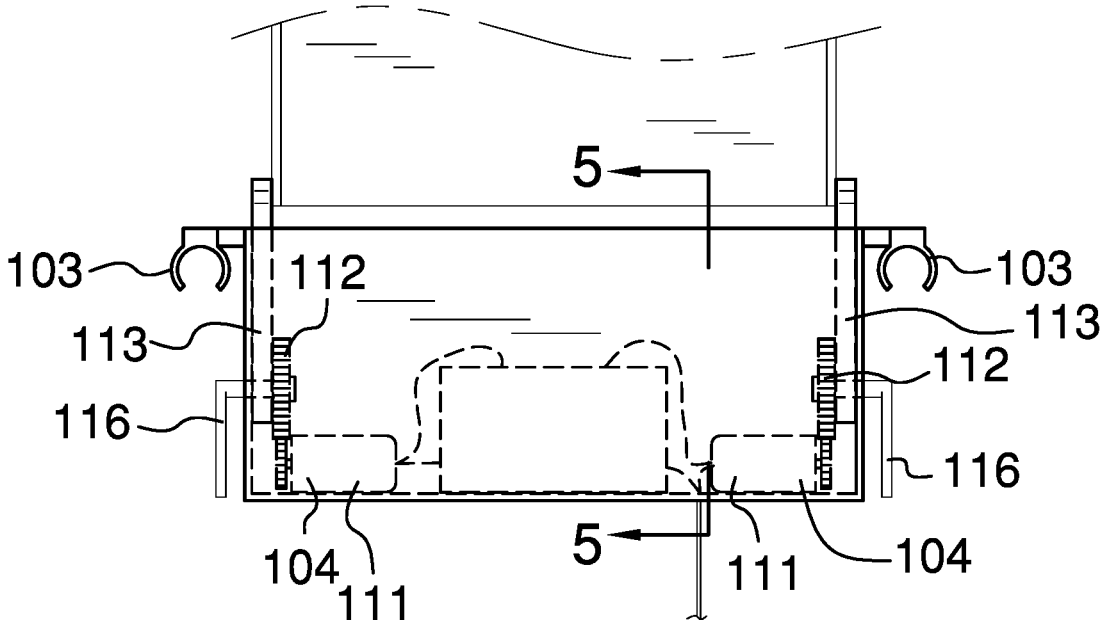
FIG. 2 is a back view of an embodiment of the disclosure.
Figure 3:
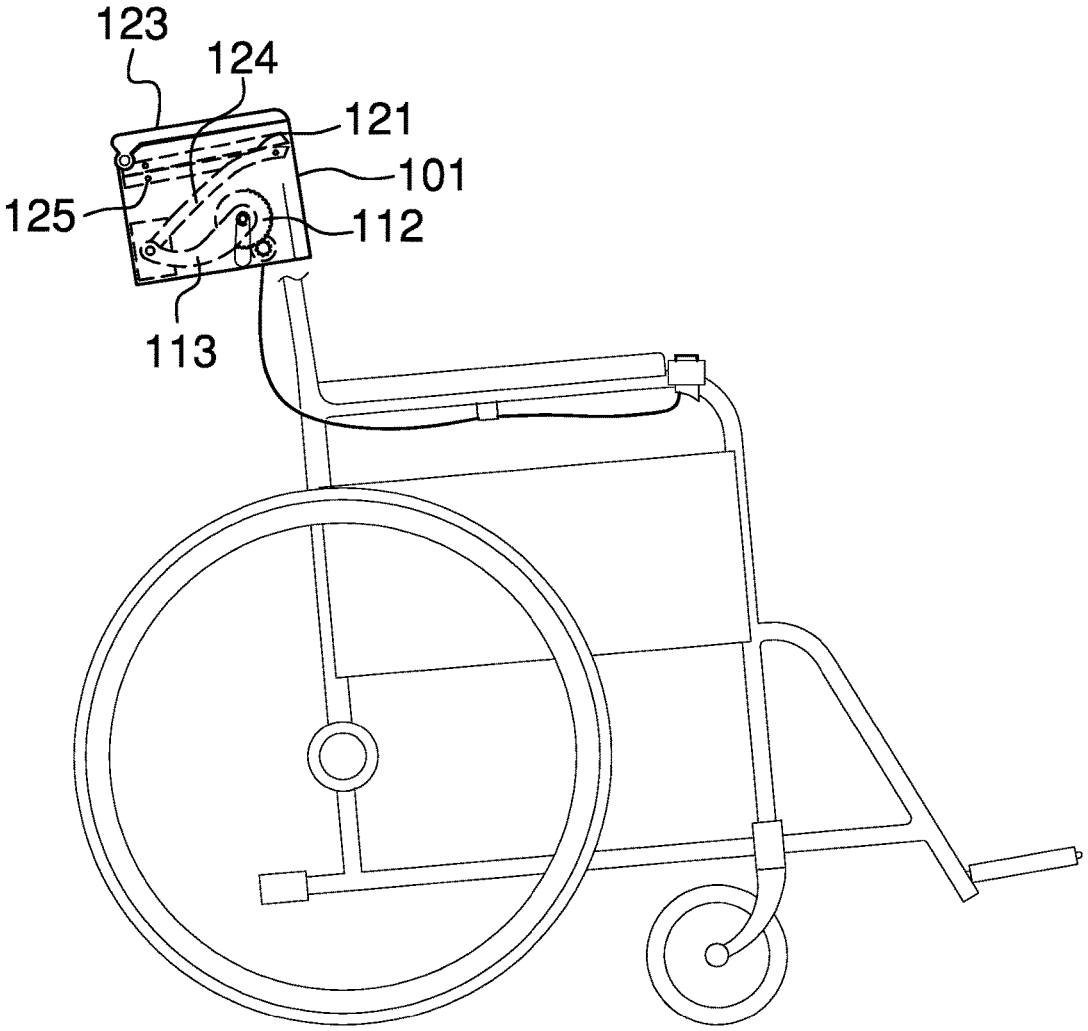
FIG. 3 is a side closed view of an embodiment of the disclosure.
Figure 4:
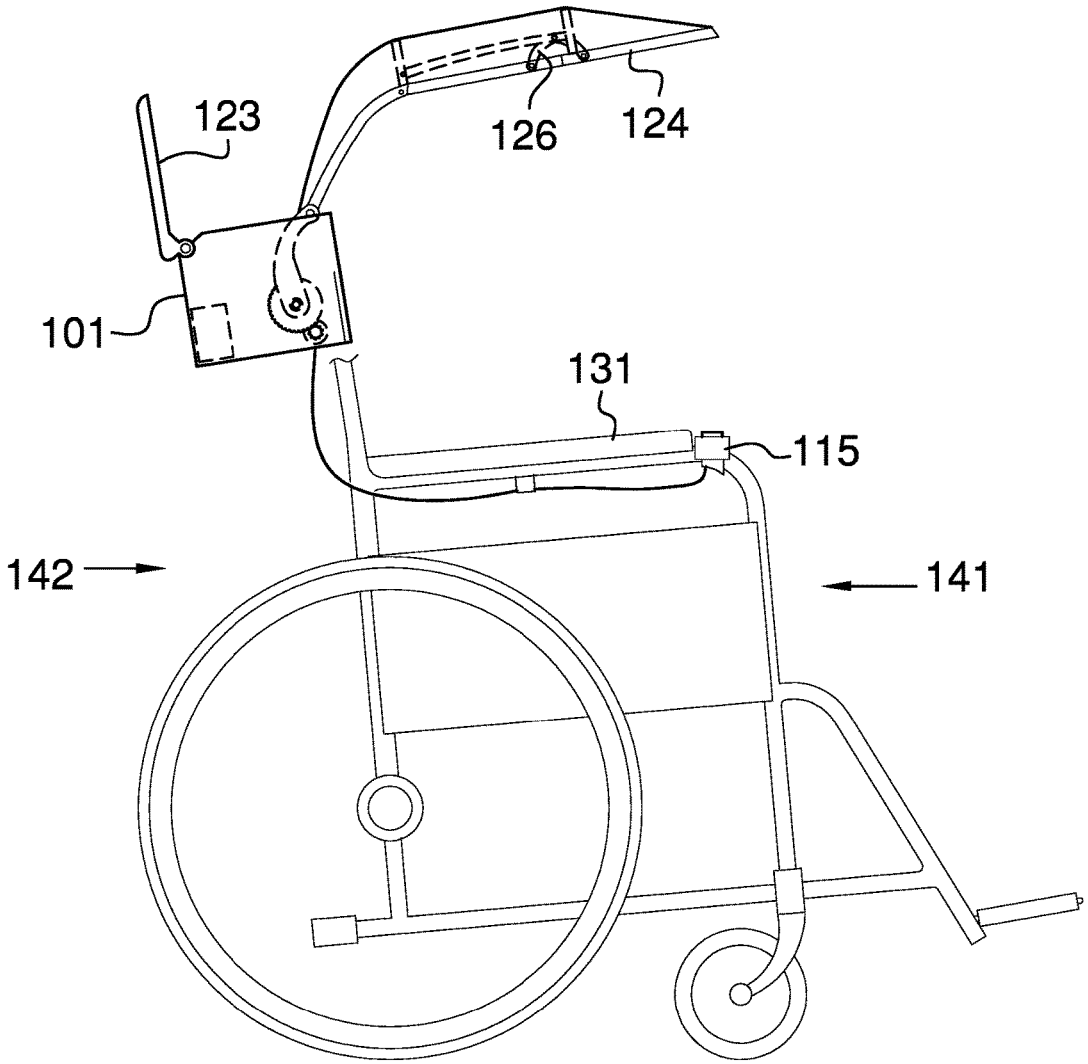
FIG. 4 is a side open view of an embodiment of the disclosure.
Figure 5:
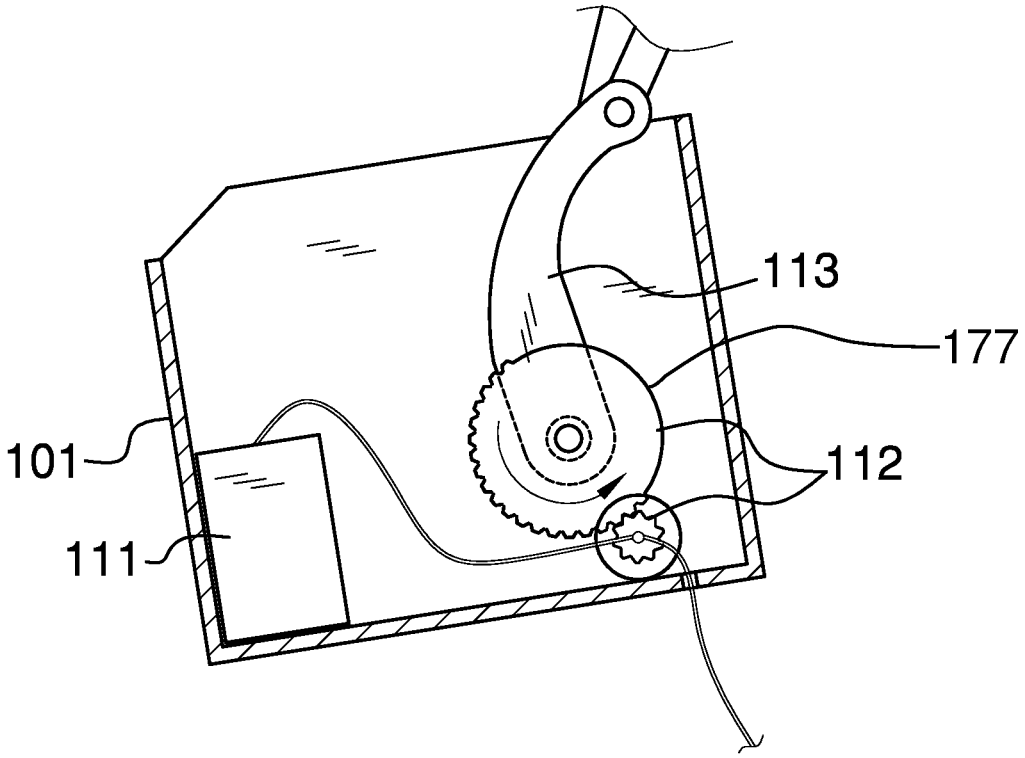
FIG. 5 is a cross-sectional view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a plurality of potential embodiment of the disclosure, which are illustrated in FIGS. 1 through 6.

The retractable canopy for wheelchair 100 (hereinafter invention) comprises a boot 101, a canopy 102, a plurality of clips 103, and an extension structure 104. The invention 100 is a convertible top for a wheelchair 131. The invention 100 is a convertible design that can be extended or retracted as needed to protect the occupant of the wheelchair 131 from weather. The invention 100 is a collapsible canopy structure that provides overhead protection from weather and that can be stored in a boot when the invention 100 is not in use. Optionally, the invention 100 can have a motorized extension and retraction system. The invention 100 is mounted on the rear of the wheelchair 131.

The boot 101 is a box that is mounted on the back side 142 of the wheelchair 131. The back side 142 is the side of the wheelchair 131 that is distal from the direction of travel of the wheelchair 131. The front side 141 of the wheelchair 131, which is traditionally considered to be the side of the wheelchair 131 that is proximal to the direction of travel, is the side of the wheelchair 131 that is distal from the back side 142. The boot 101 is sized to receive and store the canopy 102 when the invention 100 is retracted. The canopy 102 is discussed elsewhere in this disclosure. The boot 101 is further fitted with a hinged lid 123 that is used to conceal the canopy 102 when not in use. The plurality of clips 103 attaches the boot 101 to the wheelchair's 131 plurality of push handles 132. Each of the plurality of clips 103 is a readily and commercially available U bolt that is used to attach the box 101 to the shaft that forms a push handle selected from the plurality of push handles 132.

The canopy 102 further comprises a frame 121 and a cover 122. The cover 122 is a flexible textile or sheeting that provides the barrier between the wheelchair 131 occupant and weather. The frame 121 further comprises a plurality of struts 124, a plurality of hinges 125, and a plurality of gears, cams 177, and springs 126. The cover 122 is mounted on the frame 121 such that the cover 122 will fold when the canopy 102 is retracted and the cover 122 will extend when the canopy 102 is extended. Methods to attach covers 122 to frames 121 are well known in the industrial textile arts. Methods to form collapsible frames 121 from a plurality of struts 124, a plurality of hinges 125, and a plurality of gears, cams 177, and springs 126 are well known in the mechanical arts. In the first potential embodiment of the disclosure and the second potential embodiment of the disclosure, the structure of the frame 121 is modeled after the frame of a convertible top of an automobile.

The extension structure 104 is an apparatus that is designed to extend and retract the canopy 102. The extension structure 104 further comprises a manual lever 116, a gearing system 112, and one or more attachment struts 113. The purpose of the extension structure 104 is to attach the canopy 102 into the boot 101 and to transmit energy from either one or more motors 111 or a manual lever 116 to extend and retract the canopy 102. In the first potential embodiment of the disclosure, the manual lever 116 provides the motive force required to power the extension and retraction of the canopy 102. The gearing system 112 comprises the collection of gears, cams and springs required to transmit energy from the manual lever 116 to the canopy 102. The one or more attachment struts 113 directly attach the gearing system 112 of the extension structure 104 to the frame 121 of the canopy 102 to power the extension and the retraction of the canopy 102.

Figure 6:
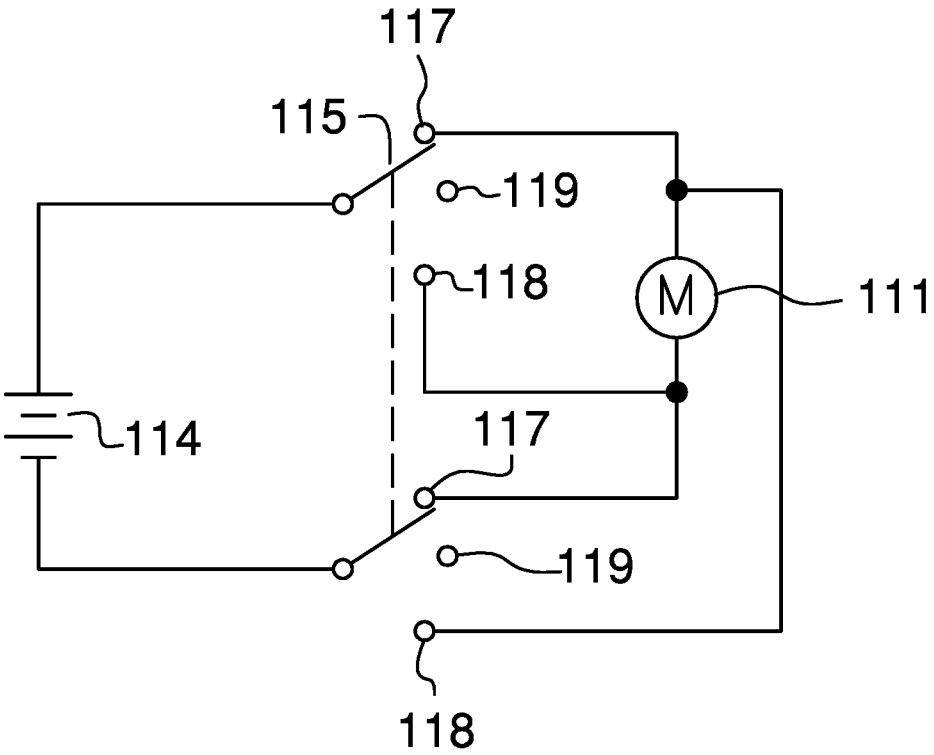
FIG. 6 is an electric schematic view of an embodiment of the disclosure.

In the second potential embodiment of the disclosure, as shown most clearly in FIGS. 2 through 5, the manual lever 116 is replaced by one or more motors 111, a battery 114, and a switch 115. Each of the one or more motors 111 are an electric motor that replaces the function of the manual lever 116 in the first potential embodiment of the disclosure. The battery 114 provides electric power to the one or more motors 111. As shown in FIG. 6, the switch 115 is used initiate the extension and the retraction of the canopy 102. As shown in FIG. 6, the switch 115 is a double pole triple throw switch that is used to connect the battery 114 to the one or more motors 111. As shown most clearly in FIG. 3, the switch 115 is mounted on the arm rest 133 of the wheelchair 131.

Methods to use levers, motors, and gears systems to extend and retract structures are well known and documented in the mechanical arts.

To use the invention 100, the invention 100 is attached to the plurality of push handles 132 using the plurality of clips 103. In the first potential embodiment of the disclosure, the manual lever 116 is rotated to rotate the gearing system 112 to extend or retract the canopy 102. In the second potential embodiment of the disclosure, the switch 115 has a retract position 117, an extend position 118, and an off position 119. To extend or retract the canopy 102, the switch 115 is placed in the appropriate position.

The following definitions were used in this disclosure:

Battery: As used in this disclosure, a battery is a container consisting of one or more cells, in which chemical energy is converted into electricity and used as a source of power.

Electric Motor: In this disclosure, an electric motor is a machine that converts electric energy into rotational mechanical energy.

Hinge: As used in this disclosure, a hinge is a device that permits the turning, rotating, or pivoting of a first object relative to a second object.

Motor: As used in this disclosure, a motor refers to the method of transferring energy from the external power source into mechanical energy.

Sheeting: As used in this disclosure, sheeting is a material, such as cloth or plastic, in the form of a thin flexible layer or layers.

Textile: As used in this disclosure, a textile is a material that is woven, knitted, braided or felted. Synonyms in common usage for this definition include fabric and cloth.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An apparatus comprising:

a boot, a canopy, a plurality of clips, and an extension structure;

wherein the apparatus is adapted for use with a wheelchair;

wherein the apparatus is a convertible top for the wheelchair;

wherein the apparatus is able to be extended or retracted as needed;

wherein the apparatus protects an occupant of the wheelchair from weather;

wherein the canopy further comprises a frame and a cover;

wherein the canopy provides overhead protection from weather;

wherein the canopy is stored in the boot when the apparatus is not in use;

wherein the extension structure extends and retracts the canopy;

wherein the boot is a rectilinear box;

wherein the boot is mounted on the back side of the wheelchair;

wherein the boot is sized to receive and store the canopy when the apparatus is retracted;

wherein the boot further comprises a hinged lid;

wherein the plurality of clips attach the boot to the wheelchair's plurality of push handles by attaching directly to the push handles;

wherein the each of the plurality of clips is a downwardly opening U bolt;

wherein the canopy further comprises a frame and a cover;

wherein the frame further comprises a plurality of struts, a plurality of hinges, and a plurality of gears, and cams.

2. The apparatus according to claim 1 wherein the extension structure further comprises a manual lever, a gearing system, and one or more attachment struts.

3. An apparatus comprising:

a boot, a canopy, a plurality of clips, and an extension structure;

wherein the apparatus is adapted for use with a wheelchair;

wherein the apparatus is a convertible top for the wheelchair;

wherein the apparatus is able to be extended or retracted as needed;

wherein the apparatus protects an occupant of the wheelchair from weather;

wherein the canopy further comprises a frame and a cover;

wherein the canopy provides overhead protection from weather;

wherein the canopy is stored in the boot when the apparatus is not in use;

wherein the extension structure extends and retracts the canopy;

wherein the apparatus has a motorized extension and retraction system;

wherein the boot is a rectilinear box;

wherein the boot is mounted on the back side of the wheelchair;

wherein the boot is sized to receive and store the canopy when the apparatus is retracted;

wherein the boot further comprises a hinged lid;

wherein the plurality of clips attach the boot to the wheelchair's plurality of push handles by attaching directly to the push handles;

wherein the each of the plurality of clips is a downwardly opening U bolt;

wherein the canopy further comprises a frame and a cover;

wherein the frame further comprises a plurality of struts, a plurality of hinges, and a plurality of gears, and cams;

wherein the extension structure further comprises a one or more motors, a battery, and a switch, a gearing system, and one or more attachment struts.

* * * * *